United States Patent [19]

Hatcher

[11] Patent Number: 5,037,163

[45] Date of Patent: Aug. 6, 1991

[54] KEYBOARD DRAWER ASSEMBLY

[75] Inventor: David O. Hatcher, Williamsville, N.Y.

[73] Assignee: Posting Equipment Corporation, Buffalo, N.Y.

[21] Appl. No.: 504,247

[22] Filed: Apr. 4, 1990

[51] Int. Cl.[5] ..... A47B 88/00

[52] U.S. Cl. ..... 312/323; 108/5; 108/143; 248/371

[58] Field of Search ..... 108/5, 143, 1, 6; 312/323, 246, 208, 29; 248/371, 396, 286

[56] References Cited

U.S. PATENT DOCUMENTS

| | | | |
|---|---|---|---|
| 2,869,958 | 1/1959 | Hough | 312/323 |
| 4,515,086 | 5/1985 | Kwiecinski et al. | 108/143 |
| 4,624,510 | 11/1985 | Jedziniak . | |
| 4,648,574 | 3/1987 | Granlund . | |
| 4,691,888 | 9/1987 | Cotterill . | |
| 4,717,112 | 1/1988 | Pickle . | |
| 4,735,466 | 4/1988 | Wolters et al. . | |
| 4,736,689 | 4/1988 | Stanko | 312/246 |
| 4,766,422 | 8/1988 | Wolters et al. . | |
| 4,982,923 | 1/1991 | Wanner | 248/371 |

OTHER PUBLICATIONS

Brochure by Uarco, Quality Computer Supplies and continuous Forms Spr/Sum Ed, 1989.

Brochure by Wrightline Fall/Winter 1988/1989.

*Primary Examiner*—Kenneth J. Dorner

*Assistant Examiner*—Gerald A. Anderson

*Attorney, Agent, or Firm*—Hodgson Russ Andrews Woods & Goodyear

[57] ABSTRACT

An improved drawer assembly which may be secured underneath a desk top or the like, the drawer assembly being capable of supporting a computer keyboard or the like for movement between storage and working locations and which will permit the keyboard to be in various positions of vertical and tilting adjustment, which positions of adjustment will be maintained as the keyboard drawer is moved between storage and working positions.

1 Claim, 2 Drawing Sheets

Fig. 1.
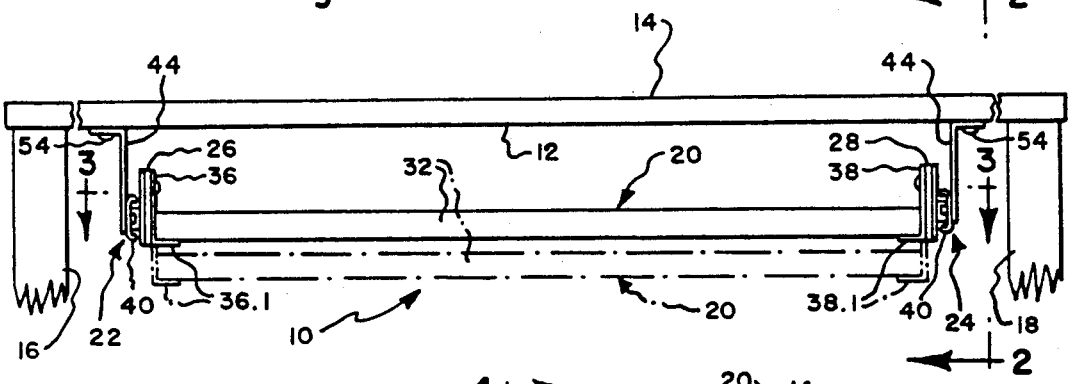
Fig. 2.
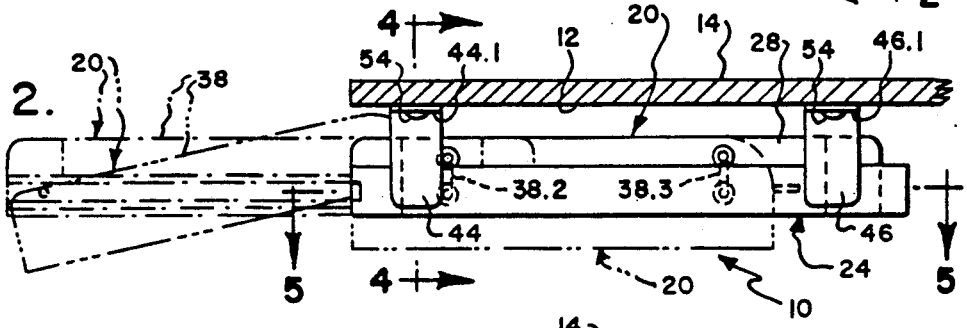
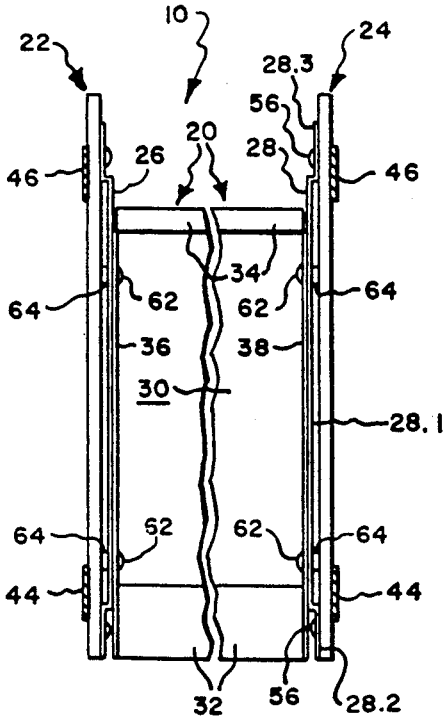
Fig. 3.
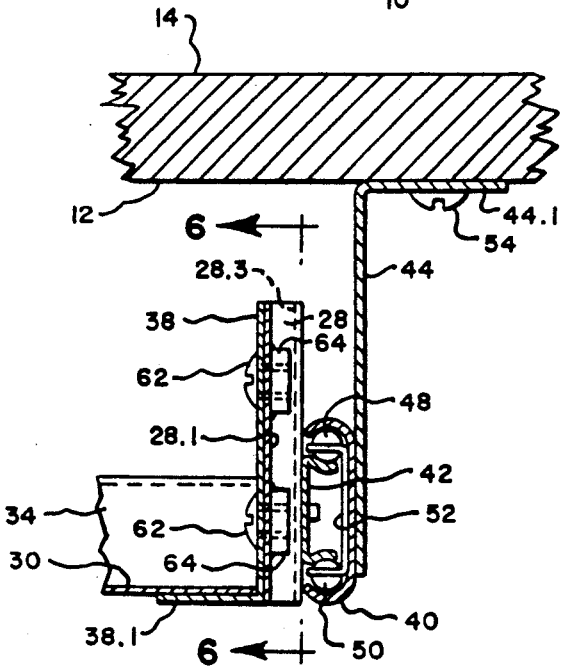
Fig. 4.

Fig. 5.
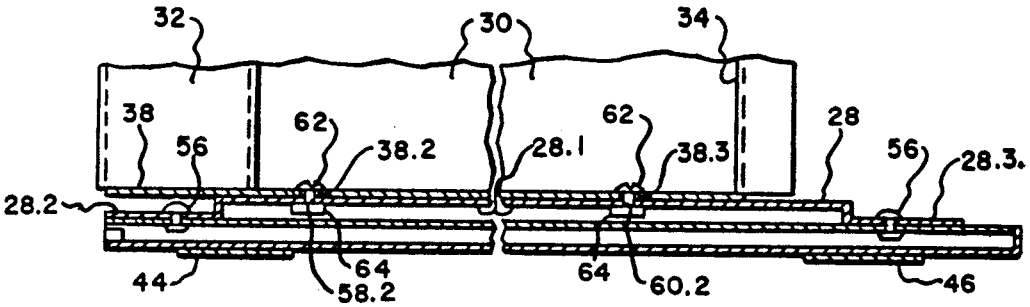
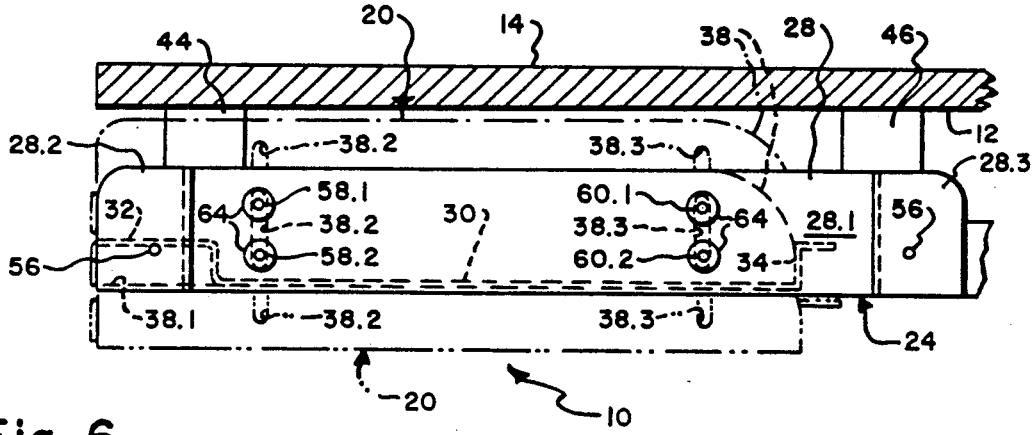
Fig. 6.
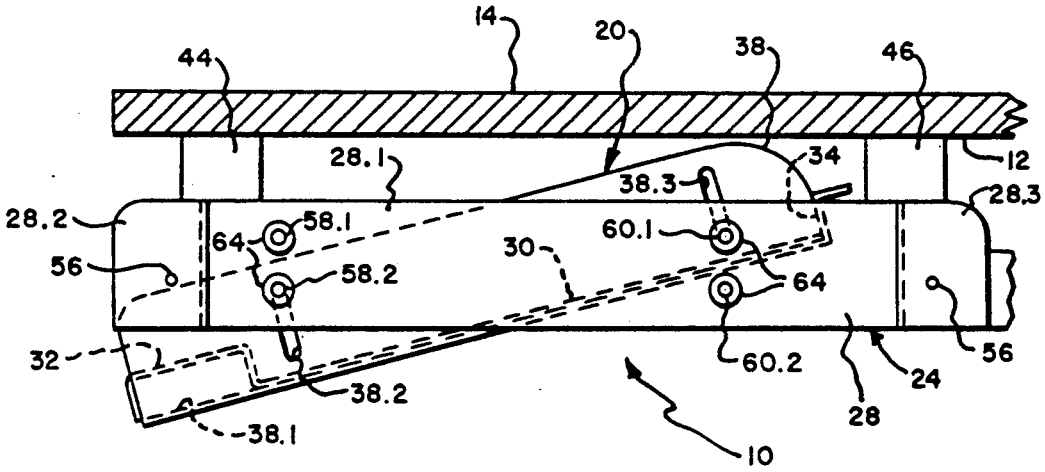
Fig. 7.

KEYBOARD DRAWER ASSEMBLY

FIELD OF THE INVENTION

The present invention relates generally to office furniture and the like, and more specifically to a keyboard drawer assembly for supporting a computer keyboard, which drawer assembly may hold the keyboard in a storage position below a desk top or the like and which permits the keyboard to be moved to a working location forward of the desk top, the drawer assembly being movable between various positions of vertical adjustment and also capable of being tilted, which positions vertical adjustment and tilting adjustment may be maintained as the drawer assembly is moved between its working and storage positions.

BACKGROUND OF THE INVENTION

Keyboard drawers are well known in the art and typically comprise a drawer which is mounted upon left and right slide assemblies secured to the bottom surface of a desk top or the like. It is also well known to provide shelves for keyboards which may be mounted either forward of the desk top surface or within a front cutout of the desk, as shown for example in U.S. Pat. No. 4,515,086. This patent discloses that the keyboard support may be vertically adjusted and it is also possible, to a limited extent, to tilt the surface shown in this patent. In supports which are mounted forward of the desk top, such as for example as shown in U.S. Pat. No. 4,691,888, it is also possible to vary the tilt and height of the keyboard. However, the design shown in these latter two patents does not permit the storage of the keyboard under the desk top. Designs which do permit the storage of a keyboard under the desk top are not presently known which permit the height of the keyboard to be varied as well as the tilt of the keyboard, which positions can be maintained as the keyboard is moved between working and storage locations.

OBJECT AND SUMMARY OF THE INVENTION

It is an object of the present invention to provide an improved keyboard drawer assembly which may be secured underneath a desk top or the like, the drawer assembly being capable of supporting a computer keyboard or the like for movement between storage and working locations and which will permit the keyboard to be in various positions of vertical and tilting adjustment, which positions of adjustment will be maintained as the keyboard is moved between storage and working positions.

The foregoing is accomplished by providing a pair of left- and right-hand slide assemblies which can be secured to spaced apart locations beneath a desk top, a drawer subassembly and left- and right-hand intermediate mounting sidewalls. The drawer subassembly includes left- and right-hand drawer sidewalls, each of the drawer sidewalls being provided with fore-and-aft spaced apart vertical slots. The left- and right-hand intermediate mounting sidewalls are mounted on the slide assemblies. The mounting or outer sidewalls are provided with fore-and-aft spaced apart apertures which receive fastening means which also pass through the slots in the drawer or inner sidewalls so that the drawer subassembly may be vertically adjusted and tilted with respect to the left- and right-hand mounting sidewalls.

The foregoing will become more fully understood after a consideration of the following detailed description taken in conjunction with the accompanying drawings in which a preferred form of this invention is illustrated.

BRIEF DESCRIPTION OF THE DRAWINGS

FIG. 1 is a front elevational view of the keyboard drawer assembly of this invention, the drawer assembly being mounted on the bottom surface of a tabletop or the like, the drawer assembly including a drawer subassembly which is shown in full lines in a raised position of adjustment and in dot-dash lines in a lower position of adjustment.

FIG. 2 is a sectional view taken generally along the line 2—2 in FIG. 1 and showing the keyboard drawer subassembly in various positions of adjustment.

FIG. 3 is a top sectional view of the keyboard drawer assembly of this invention, this view being taken generally along the line 3—3, intermediate parts being broken out.

FIG. 4 is a detailed sectional view showing the right-hand slide subassembly and the right-hand inner and outer sidewalls.

FIG. 5 is an enlarged top sectional view somewhat similar to FIG. 3, this view being taken generally along the line 5—5 in FIG. 2.

FIG. 6 is a view taken generally along the line 6—6 showing how the drawer subassembly may be vertically adjusted.

FIG. 7 is a view similar to FIG. 6 but showing how the drawer subassembly may be tilted to its maximum tilted position of approximately 15°.

DETAILED DESCRIPTION

The keyboard drawer assembly of this invention is indicated generally at 10. It is shown in FIG. 1 secured to the lower surface 12 of a tabletop 14, which table top is supported by left- and right-hand legs 16, 18, respectively. While a table is illustrated in FIG. 1, it should be appreciated that the keyboard drawer assembly of this invention may also be secured to desks tops, work stations, and any other suitable structure.

The keyboard drawer assembly of this invention includes, as its major components, a drawer subassembly 20, a pair of left- and right-hand slide subassemblies which are indicated generally at 22 and 24, respectively, and a pair of left- and right-hand mounting outer sidewalls 26, 28, respectively. The left- and right-hand outer sidewalls are fixed to a slide portion of each of the slide subassemblies in a manner which will be described below, and similarly, the drawer subassembly is adjustably secured to the left and right outer sidewalls 26, 28 in manner which will also be descirbed below.

The drawer subassembly includes a horizontally extending shelf 30 which may be provided at its forward edge with a wrist support 32. In the embodiment illustrated the shelf 30 and wrist support 32 are formed from a single piece of sheet metal, the rear edge of which is also provided with an upturned back wall 34. A pair of left and right vertical fore-and-aft extending inner sidewalls 36, 38 are secured to the shelf 30. Each of the drawer sidewalls is generally L-shaped in cross-section. As can best be seen from FIG. 4, the drawer sidewalls include an inwardly extending lower horizontal portion 36.1, 38.1 to which the shelf 30 is secured as by spot welds or the like. In addition, the inner and outer sidewalls are each provided with a vertical portion which is provided with fore-and-aft spaced apart vertically extending slots, the front slots of the right inner sidewall being indicated at 38.2 and the rear slots at 38.3. While the slots in the left-hand inner sidewall 36 are not illustrated in the drawings, it should be appreciated that the left-hand inner or drawer sidewall is provided with front and rear vertical slots comparable in dimensions and spacing to the front and rear vertical slots 38.2 and 38.3.

Each of the slide assemblies is of a design well known in the prior art and includes a track 40, a slide 42, and fore-and-aft brackets 44, 46, respectively, which brackets are spot welded on otherwise rigidly secured to the associated track 40. The slide moves within the track 40 and is supported by upper and lower sets of balls 48, 50, respectively, the balls being retained in their position by a ball retainer 52. Each of the brackets 44, 46 is provide with a suitably apertured horizontal upper end portion 44.1 or 46.1 which may receive a screw 54 or the like for the purpose of securing the bracket to the bottom surface 12 of the tabletop 14. The slide and mounting bracket assembly described above is available from Waterloo Metal Stamping, Kitchner, Ontario, Canada.

Each of the outer or mounting sidewalls which are used to mount the drawer subassembly to the associated slide assemblies consist essentially of a single piece of sheet metal, the outer sidewalls 26 and 28 being mirror images of each other. Thus, as can best be seen from FIG. 5, the right outer sidewall includes an intermediate portion 28.1 and parallel but offset fore-and-aft portions 28.2 and 28.3, respectively. Each of the fore-and-aft portions are adapted to abut the slide of the associated slide subassembly 24 and is secured thereto by tubular rivets 56 which pass through suitable apertures in the fore-and-aft portions 28.2 and 28.3, respectively. The intermediate portion 28.1 is, as previously indicated, offset and is provided with fore and aft apertures. More specifically, the intermediate portion 28.1 is provided with upper and lower sets of apertures, there being a fore or forward set including an upper forward aperture 58.1 and lower forward aperture 58.2. Similarly there is an upper rear aperture 60.1 and a lower rear aperture 60.2. These forward and rear sets of apertures are spaced apart a distance substantially equal of the distance between the front and rear slots 38.2 and 38.3 so that the slots and apertures may be in alignment with each other. The width of the slots is such that even though the drawer subassembly may be tilted with respect to the outer sidewall to the extent shown in FIG. 7, there will be still be sufficient register between the apertures and slots to accept the receipt of a fastener such as a machine screw 62. To facilitate the assembly of the inner sidewalls 36, 38 to the outer sidewalls 26, 28, the outer sidewalls have weld nuts 64 welded thereto about each of the apertures 58 or 60.

The keyboard assembly of this invention will be initially assembled with the drawer being loosely secured to the outer sidewalls, which outer sidewalls are secured to the slides of the slide assemblies. To mount the drawer assembly onto a desk, it is only necessary to mount the slides to the bottom surface of the desk drawer. By loosening the screws 62 the drawer subassembly may be disposed in various positions of adjustment. Typically, the screws 62 will initially be positioned in the upper set of apertures 58.1, 60.1 to conserve space for shipping. If it is desired to have the drawer in a lower position, the screws 62 may be removed from the weld nuts associated with upper apertures 58.1, 60.1 and positioned in the apertures 58.2 and 60.2. Alternatively, if a maximum tilt is desired, which position is illustrated in FIG. 7, the forward screw 62 may be positioned in the lower aperture 58.2 and the rear screw in the upper rear aperture 60.1. In this connection, it should be noted that the upper rear corner of the inner sidewalls 36, 38 are relieved to permit maximum tilting. To this end, they are customarily provided with a large radius surface 66.

While a preferred structure in which the principles of this invention have been incorporated is shown and described above, it is to be understood that this invention is not to be limited to the particular details shown and described above, but that, in fact, widely differing means may be employed in the practice of the broader aspects of this invention.

What is claimed is:

1. The keyboard drawer assembly which may be secured beneath a desk top or the like, the drawer assembly being capable of supporting a computer keyboard or the like for movement between storage and working locations in various positions of vertical and tilting adjustment; the drawer assembly comprising:

a drawer subassembly including a horizontally extending shelf and a pair of left- and right-hand vertical fore-and-aft extending inner sidewalls rigidly connected to the shelf, each of the inner sidewalls being provided with fore-and-aft spaced apart vertically extending slots, the upper aft corner of each of the inner sidewalls being curved to provide for additional tilting;

a pair of left- and right-hand vertical fore-and-aft extending outer sidewalls, each of the outer sidewalls having fore, intermediate, and aft parallel sections, the fore and aft sections being disposed outwardly of the intermediate section, the intermediate section being provided with upper and lower sets of fore-and-aft spaced apart fastener receiving apertures;

fasteners passing through said slots and said apertures to secure the drawer subassembly in various positions of vertical and tilting adjustment with respect to the outer sidewalls; and a pair of left- and right-hand slide subassemblies for interconnecting the left- and right-hand outer sidewalls with a desk top, each of the left- and right-hand slide assemblies including a pair of upwardly extending brackets which may be secured to the bottom surface of the desk top, a fore-and-aft extending track forming structure for sliding movement between storage and working locations, the fore and aft sections of the left- and right-hand outer sidewalls being rigidly connected to the movable track structure of the left- and right-hand track subassemblies, respectively.

* * * * *